United States Patent [19]

Talley

[11] 4,317,519

[45] Mar. 2, 1982

[54] PORTABLE SHOESHINE KIT

[76] Inventor: Leroy Talley, 1078 Park Pl., Brooklyn, N.Y. 11213

[21] Appl. No.: 202,928

[22] Filed: Nov. 3, 1980

[51] Int. Cl.[3] ..... B65D 69/00

[52] U.S. Cl. ..... 206/577; 206/223; 297/440

[58] Field of Search ..... 206/216, 223, 577, 542; 297/440, 423

[56] References Cited

U.S. PATENT DOCUMENTS

| | | | |
|---|---|---|---|
| 1,239,023 | 9/1917 | McElhinny | 206/577 |
| 2,697,460 | 12/1954 | Barnett | 206/223 |
| 2,742,956 | 4/1956 | Cannata | 206/216 |
| 2,968,394 | 1/1961 | Appelt | 206/216 |
| 3,118,685 | 1/1964 | Jordan | 206/216 |
| 3,298,478 | 1/1967 | Soprani | 206/216 |
| 3,947,903 | 4/1976 | Menke | 206/216 |
| 4,024,880 | 5/1977 | Newton et al. | 206/223 |
| 4,175,659 | 11/1979 | Horian et al. | 206/223 |

*Primary Examiner*—Joseph Man-Fu Moy
*Attorney, Agent, or Firm*—Richard L. Miller

[57] ABSTRACT

A portable shoeshine kit for use by an enterprising shoeshine operator in public places; the kit including a case rollable on wheels, a collapsible seat and umbrella for a customer and a foldable stool and seat for the operator carried by the case, and the case also carrying foot rests, brushes and polishes, the case being used as a platform upon which the footrests and customer's seat and umbrella are erected.

8 Claims, 6 Drawing Figures

PORTABLE SHOESHINE KIT

BACKGROUND OF THE INVENTION

It is well known that many shoeshine boys and grownups try to do business upon a city sidewalk where many persons pass by. These itinerary entrepreneurs, by not operating from a store, are obliged to bring all their operating equipment to the spot upon the sidewalk where they work. Carrying all this equipment can be cumbersome if all assembled haphazardly together. Accordingly this is in need of an improvement.

SUMMARY OF THE INVENTION

Therefore it is a principal object of the present invention, to provide a shoeshine kit that includes all the necessary equipment for the business and which is easily portable so that it can be transported relatively very easily between home and a place for operation.

Another object is to provide a shoeshine kit that includes a case for containing all the equipment, the case travelling on wheels so as to be easy to transport, and the case becoming a platform upon which the shoeshine work is done.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENT

Figures 1, 2, 3, 4, 5, 6:
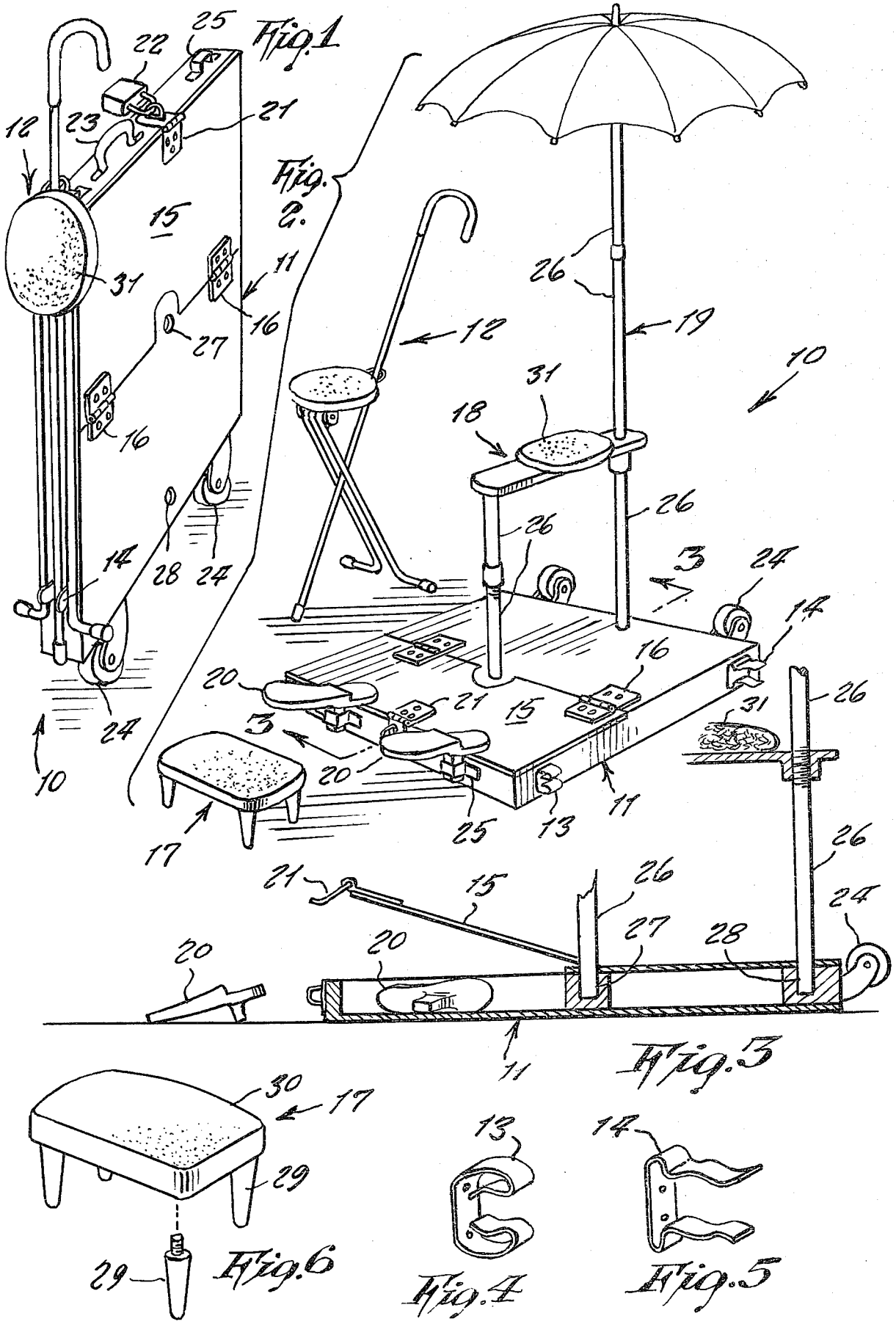
FIG. 1 is a perspective view of the kit shown assembled and in position for rolling on its wheels.
FIG. 2 is a perspective view thereof assembled and in position for working.
FIG. 3 is an enlarged cross sectional view on line 3—3 of FIG. 2, and shown with foot rests removed so as to be stored inside the case.
FIG. 4 is a perspective view of one of the chair brackets.
FIG. 5 is a perspective view of the other chair bracket.
FIG. 6 is a perspective view of the stool, showing the legs being removable so that the disassembled stool can be stored inside the case.

Referring now to the drawing in greater detail, the reference numeral 10 represents a portable shoeshine kit according to the present invention, wherein there is a case 11 inside of which may be transported all the operating equipment except a waiting chair 12 that folds up and snap fits into clips 13 and 14 on an outside of the case.

The case includes an access door 15 mounted on hinges 16 in order to carry in the case: a collapsible stool 17, a collapsible chair 18 with foldable umbrella 19, a pair of foot rests 20 and an assortment of polishing waxes and brushes (not shown).

The door is closable by a hasp 21 and secured by a padlock 22. A handle 23, upon a top of the case, allows easy hold of the case as it travels upon a pair of caster wheels 24 secured to an underside of the case.

A pair of foot rest brackets 25 are also mounted upon a top of the case, for purpose of receiving the foot rests 20 that are removably stored in the case when not in use.

In a stored away condition, the kit appears as shown in FIG. 1, and in this condition it can be transported to a place of operation by riding upon its caster wheels 24.

At the place of operation, the kit is set up, as shown in FIG. 2. The waiting chair 12 is unclipped from the case clips 13 and 14, and spread into opened position for allowing a person to sit thereupon. The case is laid down on its side, as shown, in order to form a low, broad platform. The door is pivoted up so as to remove the stored equipment from the case, and the door is then closed down again. The chair 18 and umbrella 19 comprised of telescopic aluminum tubings 26 are assembled together and the lowermost tubings are then inserted into holes 27 and 28 on the upper side of the platform so as to be supported upright. The umbrella is spread open. The foot rests are inserted into the brackets 25. The legs 29 are then fitted to the stool seat 30 so as to form the stool 17 upon which the operator then sits while polishing the shoes placed upon the foot rests by a customer seated on the pad 31 of the chair 18.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A portable shoeshine kit for use at different locations, comprising a travelling case having a bottom wall, a pair of side walls, a pair of end walls, and a top wall, said top wall having a pivotted cover for flush engagement with the top of a side wall, said travelling case defining therein at least one compartment for storing articles therein; said travelling case further comprising an intermediate partition between said pair of side walls and parallel thereto for dividing the interior of said travelling case into said plurality of compartments, said intermediate partition having a first opening formed in the top surface thereof facing toward said top wall, said opening in said intermediate partition extending part way through said intermediate wall toward said bottom wall; and one of said side walls having a second opening formed in the top surface thereof facing said top wall and extending part way through said one side wall toward said bottom wall; and said top wall having a third opening formed therethrough in alignment with said first opening of said intermediate partition, and a fourth opening formed therethrough in alignment with said second opening formed in said one side wall; and chair means upon which a person may sit, said chair means being mountable in said openings.

2. The portable shoeshine kit according to claim 1, wherein said chair means comprises a first forward leg and a second rear leg, each of said first and second legs comprising a plurality of telescoping tubings for easy assembly and disassembly, one of said tubings in each of said first and second legs being insertable into said first and third openings, and said second fourth openings, respectively, for mounting thereby; said chair means further comprising a transverse sitting pad connected between said first and second legs upon which a person sits to thereby have his shoes shined.

3. The portable shoeshine kit according to claim 1, wherein said travelling case further comprises a pair of clip means mounted on one said end wall thereof, said pair of clips being spaced from each other along the length of said one end wall; and a foldable chair upon which a person may sit to await his turn to have his shoes shined, said foldable chair being securable in said pair of clips to thereby hold said foldable chair on said travelling case during travel.

4. The portable shoeshine kit according to claim 1, wherein said travelling case further comprises a pair of brackets mounted on the other of side walls, said brackets being spaced from each other along the length of said other side wall, each said bracket defining a reception opening; and a pair of foot rests, each foot rest having a main body portion designed to the shape of a shoe, and a projecting member extending downwardly from said main body portion, said projecting member having a cross-sectional shape similar to said reception opening of each said bracket, whereby said pair of foot rests may be mounted in said pair of brackets by said projecting members, and when not being used may be stored in said at least one compartment.

5. The portable shoeshine kit according to claim 1, wherein said pivotted cover extends from near said intermediate partition toward the other of said side walls, and said top wall comprises a stationary portion having a first side surface flush with said one side wall and a second side surface flush with said intermediate partition, said pivotted cover being pivotted to said stationary portion adjacent said stationary portion flush with said intermediate partition; said pivotted cover having hinge means secured to said stationary portion.

6. The portable shoeshine kit according to claim 1, wherein said travelling case further comprises a pair of caster wheels rotatably mounted to said one side wall, said caster wheels being spaced apart along the length of said one side wall, whereby said travelling case and the articles stored therein may be transported from one location to another by rolling said travelling case along the ground via said caster wheels.

7. The portable shoeshine kit according to claim 1, further comprising a stool upon which the shoeshiner may sit while shining shoes, said stool comprising a top seat portion upon which to sit, and a plurality of legs attached to said seat portion, each said leg being removably attached to said seat portion for easy removal therefrom, whereby said stool may be stored in said at least one compartment when not being used.

8. The portable shoeshine kit according to claim 2, wherein said second rear leg of said chair means comprises an umbrella means, said umbrella means including a canopy and a telescoping tubing receivable into one of said tubings of said second rear leg, whereby when a customer sits on the chair means, he is protected from precipitation and the sun.

* * * * *